US007210276B1

(12) United States Patent
Kraft et al.

(10) Patent No.: US 7,210,276 B1
(45) Date of Patent: May 1, 2007

(54) WOODEN FLOOR

(75) Inventors: Elke Kraft, Bad Urach (DE); Thorsten Kraus, Bad Urach (DE); Juergen Koessler, Bad Urach (DE); Ralf Heinzmann, Reutlingen (DE); Roland Schneider, Ulm (DE); Hans-Christoph Thielemann, Nuertingen (DE); Morten Muschak, Munderkingen (DE); Norbert Singer, Zurich (CH); Michael Geissbuehler, Schwarzenberg (CH); Josef Wolf, Zurich (CH); Beat Maerki, Ruefenach (CH); Dieter Geng, Daellikon (CH); Ueli Pfenninger, Au (CH); Philippe De Vriendt, Paris (FR); Fabio Guerrini, Milan (IT)

(73) Assignee: Sika Chemie GmbH (DE)

( * ) Notice: Subject to any disclaimer, the term of this patent is extended or adjusted under 35 U.S.C. 154(b) by 515 days.

(21) Appl. No.: 10/009,959

(22) PCT Filed: Jun. 15, 2000

(86) PCT No.: PCT/EP00/05488

§ 371 (c)(1),
(2), (4) Date: Dec. 12, 2001

(87) PCT Pub. No.: WO00/79074

PCT Pub. Date: Dec. 28, 2000

(30) Foreign Application Priority Data

Jun. 18, 1999 (DE) ..... 199 28 030

(51) Int. Cl.
*E04B 1/00* (2006.01)
*E04G 21/00* (2006.01)
*E04G 23/00* (2006.01)

(52) U.S. Cl. ..... 52/747.11; 52/390; 524/271; 524/764; 156/74

(58) Field of Classification Search ..... 52/749.4, 52/747.11, 746.1, 177, 390; 524/270, 271, 524/764, 35, 272, 274; 156/71, 299, 297, 156/331.7, 329
See application file for complete search history.

(56) References Cited

U.S. PATENT DOCUMENTS 3,365,850 A * 1/1968 Marino ..... 52/309.3

(Continued)

FOREIGN PATENT DOCUMENTS

CH 331 526 9/1958

(Continued)

OTHER PUBLICATIONS

DIN 281 entitled "Parkettklebstoffe" published Apr. 1991 of the German government.

*Primary Examiner*—Naoko Slack
*Assistant Examiner*—Chi Q. Nguyen
(74) *Attorney, Agent, or Firm*—Akerman Senterfitt

(57) ABSTRACT

The invention relates to a wooden floor, consisting of a hardenable adhesive (12) which is painted onto a floor base (10) in a continuous layer, and covering elements (16) consisting of wood or a wood material that are joined to the adhesive in its entirety by their surface (14) to be glued. According to the invention, the adhesive layer (12) has a thickness of 0.5 to 5 mm and the combined tension and shear strength of the adhesive (12), in its hardened state, is les than that of the floor base (10) and is at most 1.2 N/mm$^2$, in order to obtain a floor covering with excellent dimensional stability.

16 Claims, 1 Drawing Sheet

U.S. PATENT DOCUMENTS 4,233,793 A * 11/1980 Omholt ..... 52/390
4,360,992 A * 11/1982 Marino ..... 52/309.4
4,416,100 A * 11/1983 Troendle, Sr. ..... 52/390
4,543,765 A * 10/1985 Barrett ..... 52/747.11
5,137,764 A * 8/1992 Doyle et al. ..... 428/44
5,227,409 A * 7/1993 Mobley et al. ..... 521/167
5,255,482 A * 10/1993 Whitacre ..... 52/390
5,564,251 A * 10/1996 Van Bers ..... 52/747.11
5,584,957 A * 12/1996 Schultheis et al. ..... 156/289
5,721,302 A * 2/1998 Wood et al. ..... 524/271
6,354,058 B1 * 3/2002 Lewis ..... 52/749.11

FOREIGN PATENT DOCUMENTS

| | | |
|---|---|---|
| DE | 12 23 089 | 8/1966 |
| DE | 26 30 634 A1 | 1/1977 |
| DE | 297 02 871 U1 | 5/1997 |
| GB | 1 558 408 | 1/1980 |

* cited by examiner

WOODEN FLOOR

BACKGROUND OF THE INVENTION

1. Field of the Invention

The invention concerns a wood floor, comprising a hardenable of curable adhesive which is coated as a continuous layer onto a floor base, and covering elements of wood or a wood material that are bonded to the adhesive over their entire surface to be glued.

2. Description of the Related Art

For adhering covering elements used to make parquet or inlay floors, adhesives are conventionally employed which are comprised of natural and/or synthetic resins and include suitable solvents and additives. According to applicable DIN (German Industrial Standard) 218, the parquet adhesives exhibit a shear strength of at least 3 to 3.5 N/mm$^2$, which results in a hard and brittle junction of the covering elements to the base floor. The adhesive is applied using a toothed trowel. When laying the parquet floor, attention must be paid to the fact that the parquet wood expands when absorbing moisture and shrinks when (re)drying. The parquet wood conventionally contains 9% water during the laying process. The moisture content can change due to water uptake in a new construction through the sub-floor, or from the environment, or as a result of the variable humidity depending upon the season. The expansion and shrinking caused thereby must be absorbed or accepted by the adhesive material. Thereby, substantial shear forces result. These shear forces can in certain cases result in a bowing out of the parquet wood or result in gaps or formation of splits. In the case of breakage it frequently occurs that not only the adhesive joint but rather also the sub-floor comprised of cement is damaged. This is due to the fact that the shear strength of the cement floor is relatively low in comparison to the parquet adhesive according to DIN 281. On the other hand, during drying the parquet pieces shrink. Since the parquet adhesive does not permit a shrinking at the point of adhesion, frequently large gaps occur between the parquet pieces.

SUMMARY OF THE INVENTION

Beginning therewith, it is the task of the invention to develop a floor which can transmit the shear forces, resulting from expansion due to absorption of moisture and contraction due to drying back again, from the wood parquet elements to the sub-floor without separation of the adhesion bond and bowing out of the floor covering.

For the solution of this task, there is proposed a floor, comprised of a sub-floor continuously covered with a layer of cured adhesive, and covering elements of wood or wood materials completely covered on their surface to be adhered with the adhesive, wherein the adhesive layer has a layer thickness of 0.5 to 5 mm, and wherein the adhesive has a shear strength in the cured condition which is less than that of the sub-floor. Advantageous embodiments and further developments of the invention can be found in the dependent claims.

The inventive solution is based upon the idea, that the forces occurring during expansion and shrinking of the parquet elements can only be transmitted to the sub-floor without an impermissible localized accumulation of forces when they are distributed and evenly diffused, within the adhesive layer, over the entire adhesive surface. In order to achieve this, it is proposed in accordance with the invention than the adhesive layer has a thickness of 0.5 to 5 mm and that the adhesive in the hardened condition exhibits a shear strength which is less than that of the sub-floor. The shear strength of cement floors is an average of approximately 1.2 N/mm$^2$. In accordance therewith an adhesive is selected, of which the shear strength is less than 1.2 N/mm$^2$, preferably 0.6 to 1.0 N/mm$^2$. Preferably, a reaction adhesive is selected which hardens with a Shore Hardness (A) of 20 to 35. Thereby it is achieved that, in the case of expansion or shrinking, the forces occurring at the adhesive layer are evenely distributed over the entire adhesive surface. There are no force or tension peaks, which can lead to a release or to a break in the adhesive connection. The distribution of the forces ensures that the floor covering elements deform less in the case of excessive moisture or in the case of drying out. The covering elements are supported and held over large surface areas, without occurrence of breakage areas in the adhesive. Thereby, a bowing-out of the floor covering wood is avoided. On the other hand, in the case of drying out, the formation of gaps is reduced. Research has shown that the covering elements, in the case of absorbing excessive moisture, becomes somewhat compressed along their contact flanks. As a result of the pressing of wood, minor deformations occur within the wood in the edge area, which however are barely discernable from the outside. In the case of the inventive elastic adhesion, one obtains a substantially even surface loading or force distribution over the surface area. This means that the greater the adhered surface is, the greater is the force transmission or distribution. Besides this, a bonding is achieved in a way that protects the sub-floor. A substantially elastic joining also results in a substantial reduction in foot-step noise in comparison to the hard adhesives. The surprising benefit of the inventive floor covering adhesion is comprised therein, that depicts low shear strength of the employed adhesive, the avoidance of tension peaks makes it possible to achieve a substantially higher force transmission than with the convention rigid DIN adhesives.

A preferred embodiment of the invention envisions that the adhesive is comprised of a reaction adhesive, preferably a polyurethane or polyurethane hybrid, which hardens upon exposure to water. Alternatively, the adhesive can be comprised of MS-polymers (modified silicones).

The invention is further concerned with the use of elastic adhesives with a higher breaking elongation, which hardens with a shear strength of less than 1.2 N/mm$^2$, preferably from 0.6 to 1.0 N/mm$^2$, for adhering wood floors onto a sub-floor preferably comprised of cement or concrete. The inventive adhesive is preferably applied to the sub-floor using a toothed trowel to a thickness of 0.5 to 5 mm.

BRIEF DESCRIPTION OF THE DRAWING

In the following the invention will be explained in greater detail on the basis of the illustrated embodiment represented schematically in the figures. There is shown.

DETAILED DESCRIPTION OF THE INVENTION

Figure 1:
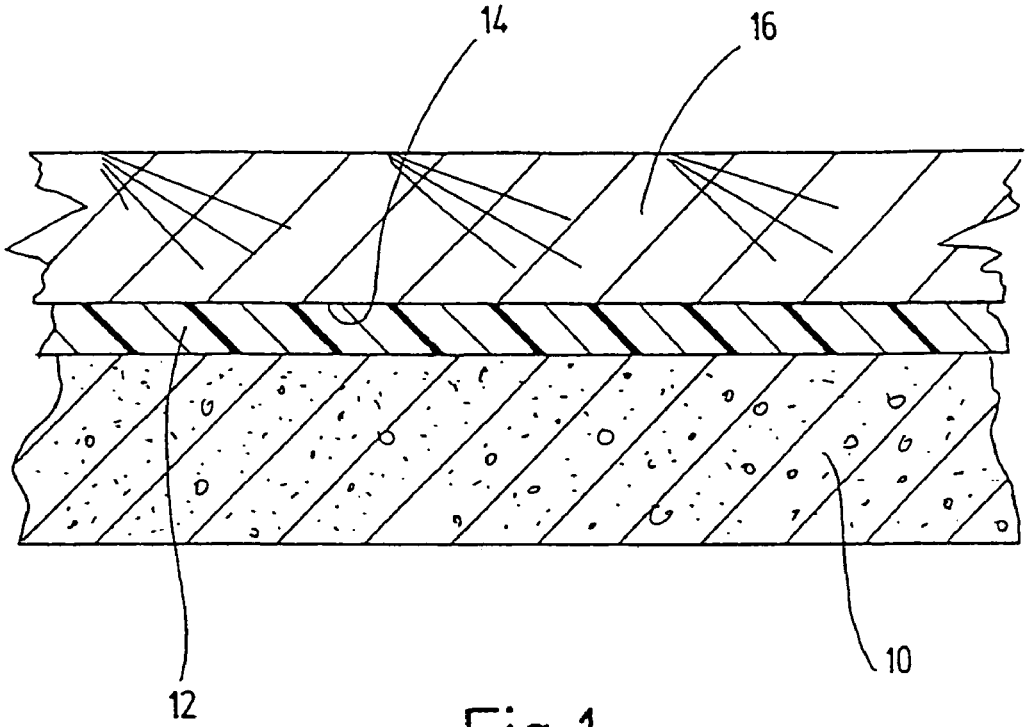
FIG. 1 a section through a wood floor.

The parquet floor shown in sectional representation in FIG. 1 is comprised of an adhesive 12 applied in a continuous layer onto a sub-floor 10 comprised of cement, and covering elements 16 which are covered over their entire surface to be adhered 14 with the adhesive 12. The adhesive is preferably comprised of a one component polyurethane which hardens upon exposure to water, which in the cured condition exhibits a shearing strength $\tau$ of less than 1.2 $N/mm^2$. The shear strength $\tau$ is a quotient of the highest force $F_{max}$ and the adhesive surface A of the floor-covering adhesive bond:

$$\tau = F_{max}/A$$

Figure 2:
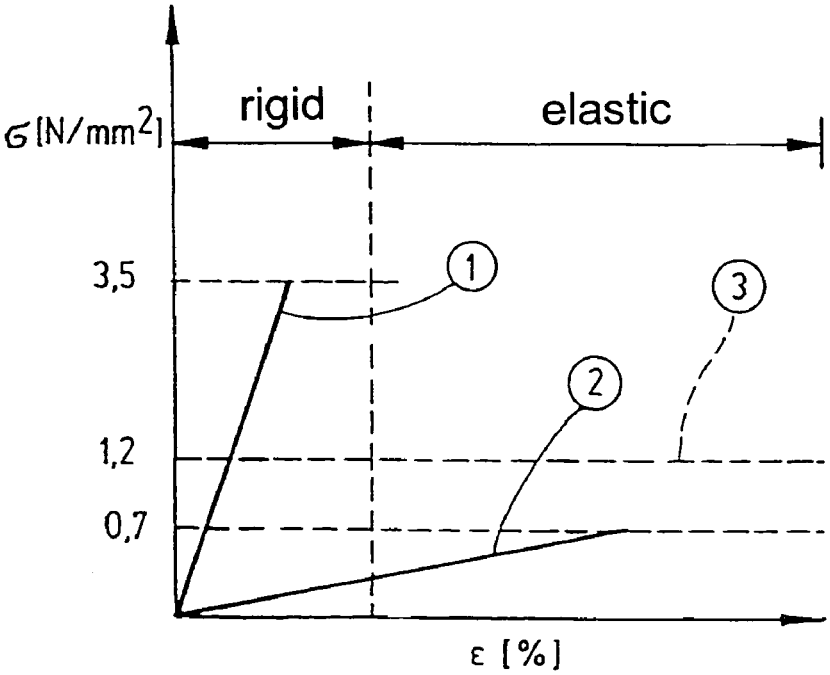
FIG. 2 a shearing stress—elongation diagram for DIN-parquet adhesives and an inventive adhesive.

In the stress-elongation diagram according to FIG. 2, the stress-elongation curve $\sigma = f(\epsilon)$ of various adhesives 1 and 2 is shown. The end of the respective curve defines the pull shear strength of the employed adhesive, which in the case of DIN-adhesive 1 is approximately 3.5 $N/mm^2$ and in the case of the inventive adhesive 2 is approximately 0.7 $N/mm^2$. As reference value there is shown with dashed line 3 in the diagram the average shear strength value of cement flooring. The inventive adhesive 2 belongs to the elastic adhesives while the floor covering adhesive 1 according to DIN 218 is non-elastic.

Experiments have shown that the elastic floor covering adhesive prevents bowing-out of the wood despite the lower shear strength of the adhesive, and this due to the even distribution of tension. The adhesion is shear resistant. Besides this, a material joining of the floor covering to the cement is produced: the shear strength of the proposed elastic adhesives 2 of 0.7 $N/mm^2$ is significantly lower than the surface rigidity of cement (1.2 $N/mm^2$). The hardness of the cured adhesive 2 is approximately 20 to 30 Shore (A). Thus, no damage to the cement floor can occur. For this reason, a pre-coating for sealing or strengthening the cement surface is not necessary. In contrast, the rigid DIN-adhesive with their shear strength of 3.5 $N/mm^2$ are significantly above that of cement. When adhering therewith, tension peaks occur at the edges of the floor covering elements. The forces resulting from the movement of wood are not distributed over the surface. Even an enlargening of the adhesive surface does not result in any improvement. In the case of the elastic adhesion, in comparison, the forces are transmitted or distributed over the entire adhesion surface: no tension peaks are produced. Thereby substantially higher forces can be transmitted with, at the same time, a lower tension exposure of the sub-floor. With the elastic adhesive no displacement occurs between the parquet elements. Besides this, a bowing out of the parquet elements is avoided.

EXAMPLE

The general characteristics of the employed parquet adhesives are as follows:

| | | |
|---|---|---|
| Shore (A) | 25–35 | |
| Break Elongation | 300–1000% | DIN 53 504 |
| Shear Strength | <1,2 $N/mm^2$ | with reference to DIN 281 |
| Recovery Value | >70% | |

In summary, the following can be concluded: The invention relates to a wooden floor, comprising of a hardenable adhesive 12 which is painted onto a floor base 10 in a continuous layer, and covering elements 16 of wood or a wood material of which the entire surface (14) to be bonded is adhered to the adhesive layer. According to the invention, the adhesive layer 12 has a thickness of 0.5 to 5 mm and the adhesive 12 has a shear strength, in its cured state, which is less than that of the sub-floor 10 and is at most 1.2 $N/mm^2$, in order to obtain a floor covering with excellent dimensional stability.

What is claimed is:

1. A floor comprising:

a sub-floor (10) continuously covered with a layer (12) of cured elastic adhesive, covering elements (16) of wood or wood materials having a surface adhered to the layer of cured elastic adhesive, wherein said covering elements are completely covered on their adhered surface with the adhesive, wherein the cured elastic adhesive (12) is applied with a layer thickness of 0.5 to 5 mm;

wherein the cured elastic adhesive has a shear strength from 0.6 to 1.0 $N/mm^2$;

wherein the shear strength of the cured elastic adhesive is less than a shear strength of the sub-floor (10); and wherein the cured elastic adhesive is a reaction adhesive.

2. The floor according to claim 1, wherein the cured adhesive is comprised of modified silicone polymers.

3. A floor comprising:

a sub-floor (10) continuously covered with a layer (12) of cured elastic adhesive, covering elements (16) of wood or wood materials having a surface adhered to the layer of cured elastic adhesive, wherein said covering elements are completely covered on their adhered surface with the adhesive, wherein the cured elastic adhesive (12) is applied with a layer thickness of 0.5 to 5 mm;

wherein the cured elastic adhesive has a shear strength of less than 1.2 $N/mm^2$;

wherein the shear strength of the cured elastic adhesive is less than a shear strength of the sub-floor (10);

wherein the cured elastic adhesive is a reaction adhesive; and wherein the cured adhesive is comprised of a reaction-type resin which hardens upon exposure to water.

4. The floor according to claim 3, wherein the resin is a polyurethane or polyurethane hybrid resin.

5. A floor comprising:

a sub-floor (10) continuously covered with a layer (12) of cured elastic adhesive, covering elements (16) of wood or wood materials having a surface adhered to the layer of cured elastic adhesive, wherein said covering elements are completely covered on their adhered surface with the adhesive, wherein the cured elastic adhesive (12) is applied with a layer thickness of 0.5 to 5 mm;

wherein the cured elastic adhesive has a shear strength of less than 1.2 $N/mm^2$;

wherein the shear strength of the cured elastic adhesive is less than a shear strength of the sub-floor (10);

wherein the cured elastic adhesive is a reaction adhesive; and wherein the cured adhesive in the hardened condition has a Shore (A) hardness of 20 to 35.

6. A floor comprising:

a sub-floor (10) continuously covered with a layer (12) of cured elastic adhesive, covering elements (16) of wood or wood materials having a surface adhered to the layer of cured elastic adhesive, wherein said covering elements are completely covered on their adhered surface with the adhesive, wherein the cured elastic adhesive (12) is applied with a layer thickness of 0.5 to 5 mm;

wherein the cured elastic adhesive has a shear strength of less than 1.2 $N/mm^2$;

wherein the shear strength of the cured elastic adhesive is less than a shear strength of the sub-floor (10);

wherein the cured elastic adhesive is a reaction adhesive; and wherein the cured adhesive in the hardened condition has a break elongation of 300 to 1000%.

7. A method for adhering floor covering elements (16) of wood or wood materials to a sub-floor (10), comprising:

applying to said sub-floor and to the surface of said floor covering elements a cured elastic adhesive to a thickness of 0.5 to 5 mm which hardens to a shear strength of 0.6 to 1.0 $N/mm^2$.

8. The method as in claim 7, wherein said sub-floor is comprised of cement, concrete or dry-construction plates.

9. The method as in claim 7, wherein the cured adhesive is a one component modified silicone polymer.

10. A method for adhering floor covering elements (16) of wood or wood materials to a sub-floor (10), comprising:

applying to said sub-floor and to the surface of said floor covering elements a cured elastic adhesive to a thickness of 0.5 to 5 mm which hardens to a shear strength less than 1.2 $N/mm^2$, wherein the cured adhesive is a polyurethane or polyurethane hybrid which hardens upon exposure to water.

11. A method for adhering floor covering elements (16) of wood or wood materials to a sub-floor (10) comprising:

applying to said sub-floor and to the surface of said floor covering elements a cured adhesive which hardens to a shore hardness (A) of 20 to 35.

12. The method as in claim 11, wherein said sub-floor is comprised of cement, concrete or dry-construction plates.

13. The method as in claim 11, wherein the cured adhesive (12) is applied with a layer thickness of 0.5 to 5 mm.

14. The method as in claim 11, wherein the cured adhesive is a polyurethane or polyurethane hybrid which hardens upon exposure to water.

15. The method as in claim 11, wherein the cured adhesive is a one component modified silicone polymer.

16. A method for adhering floor covering elements (16) of wood or wood materials to a sub-floor (10) comprising:

applying to said sub-floor and to the surface of said floor covering elements a cured adhesive which when hardened has a break elongation of 30 to 1000%.

* * * * *